US008971778B2

(12) United States Patent
Suzuki et al.

(10) Patent No.: US 8,971,778 B2
(45) Date of Patent: Mar. 3, 2015

(54) FIXING DEVICE

(71) Applicants: Noboru Suzuki, Komaki (JP); Kei Ishida, Nishi-ku (JP); Takuji Matsuno, Ichinomiya (JP); Yoshihiro Miyauchi, Ama (JP)

(72) Inventors: Noboru Suzuki, Komaki (JP); Kei Ishida, Nishi-ku (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/623,139

(22) Filed: Sep. 20, 2012

(65) Prior Publication Data

US 2013/0071155 A1 Mar. 21, 2013

(30) Foreign Application Priority Data

Sep. 20, 2011 (JP) ..... 2011-205120

(51) Int. Cl.
*G03G 15/20* (2006.01)

(52) U.S. Cl.
CPC .... *G03G 15/2064* (2013.01); *G03G 2215/2016* (2013.01); *G03G 15/2053* (2013.01); *G03G 15/2089* (2013.01); *G03G 2215/2032* (2013.01); *G03G 2215/2035* (2013.01)
USPC ..... 399/329

(58) Field of Classification Search
CPC ..... G03G 15/2064
USPC ..... 399/329
See application file for complete search history.

(56) References Cited

U.S. PATENT DOCUMENTS

| | | | | | |
|---|---|---|---|---|---|
| 5,572,307 | A * | 11/1996 | Tomatsu et al. | ..... | 399/122 |
| 6,370,353 | B1 * | 4/2002 | Baughman et al. | ..... | 399/331 |
| 7,647,016 | B2 * | 1/2010 | Saiki | ..... | 399/329 |
| 7,764,913 | B2 * | 7/2010 | Tsunoda | ..... | 399/329 |
| 7,796,932 | B2 * | 9/2010 | Geyling et al. | ..... | 399/329 |
| 7,894,734 | B2 * | 2/2011 | Sawamura et al. | ..... | 399/67 |
| 8,086,119 | B2 * | 12/2011 | Furukata et al. | ..... | 399/33 |
| 8,360,426 | B2 * | 1/2013 | Arikawa et al. | ..... | 271/273 |
| 8,447,219 | B2 * | 5/2013 | Furukata et al. | ..... | 399/329 |
| 8,543,045 | B2 * | 9/2013 | Arikawa et al. | ..... | 399/328 |
| 8,737,893 | B2 * | 5/2014 | Fujiwara et al. | ..... | 399/329 |
| 2008/0181686 | A1 * | 7/2008 | Geyling et al. | ..... | 399/329 |
| 2008/0219725 | A1 * | 9/2008 | Saiki | ..... | 399/329 |
| 2009/0226227 | A1 * | 9/2009 | Furukata et al. | ..... | 399/328 |
| 2011/0052259 | A1 * | 3/2011 | Sawamura et al. | ..... | 399/122 |

(Continued)

FOREIGN PATENT DOCUMENTS

| | | | | |
|---|---|---|---|---|
| JP | 10-181937 A | | 7/1998 | |
| JP | 10181937 | * | 7/1998 | ..... G03G 15/20 |
| JP | 199810181937 | * | 7/1998 | ..... G03G 15/20 |

*Primary Examiner* — Clayton E LaBalle
*Assistant Examiner* — Kevin Butler
(74) *Attorney, Agent, or Firm* — Banner & Witcoff, Ltd.

(57) ABSTRACT

A fixing device includes: a first fixing member and a second fixing member forming a nip portion for heat-fixing a recording sheet; an urging mechanism including an urging member and urging the first fixing member toward the second fixing member by an urging force of the urging member; a first frame for supporting the second fixing member; a second frame arranged at an opposite side to the second fixing member with the first fixing member being interposed therebetween; and a switching member, which applies a pressing force resisting the urging force to the first fixing member for switching a width of the nip portion, and which includes a cam to which the urging force is applied and a shaft for supporting the cam. The first frame and the second frame are connected to each other by the shaft.

22 Claims, 12 Drawing Sheets

(56) References Cited

U.S. PATENT DOCUMENTS

| | | | | |
|---|---|---|---|---|
| 2011/0158718 | A1* | 6/2011 | Fujiwara et al. | 399/329 |
| 2011/0211880 | A1* | 9/2011 | Furukata et al. | 399/329 |
| 2011/0318073 | A1* | 12/2011 | Arikawa et al. | 399/329 |
| 2012/0098191 | A1* | 4/2012 | Arikawa et al. | 271/272 |
| 2012/0163884 | A1* | 6/2012 | Kondo et al. | 399/329 |
| 2012/0170957 | A1* | 7/2012 | Lim et al. | 399/331 |
| 2013/0064585 | A1* | 3/2013 | Watanabe et al. | 399/329 |
| 2013/0071155 | A1* | 3/2013 | Suzuki et al. | 399/329 |
| 2013/0071159 | A1* | 3/2013 | Suzuki et al. | 399/329 |
| 2013/0302054 | A1* | 11/2013 | Uehara et al. | 399/67 |

* cited by examiner

FIXING DEVICE

CROSS-REFERENCE TO RELATED APPLICATIONS

This application claims priority from Japanese Patent Application No. 2011-205120 filed on Sep. 20, 2011, the entire subject matter of which is incorporated herein by reference.

TECHNICAL FIELD

The invention relates to a fixing device that heat-fixes a toner image on a recording sheet.

BACKGROUND

There have been known a fixing device which includes a heating member heating a recording sheet, a pressing roller forming a nip portion between the heating member and the pressing roller and a support frame having a pair of sidewalls rotatably supporting the pressing roller.

SUMMARY

Illustrative aspects of the invention provide a technique for positioning two frames with good precision in a fixing device including the two frames.

According to one illustrative aspect of the invention, there is provided a fixing device configured to heat-fix a developer image on a recording sheet. The fix device comprises: a first fixing member and a second fixing member configured to form a nip portion for heat-fixing the recording sheet; an urging mechanism comprising an urging member and is configured to urge the first fixing member toward the second fixing member by an urging force of the urging member; a first frame configured to support the second fixing member; a second frame that is arranged at an opposite side to the second fixing member with the first fixing member being interposed therebetween; and a switching member configured to apply a pressing force resisting the urging force of the urging member to the first fixing member for switching a width of the nip portion. The switching member comprises: a cam to which the urging force of the urging member is applied; and a shaft configured to support the cam. The first frame and the second frame are connected to each other by the shaft.

DETAILED DESCRIPTION

<General Overview>

Figure 1:
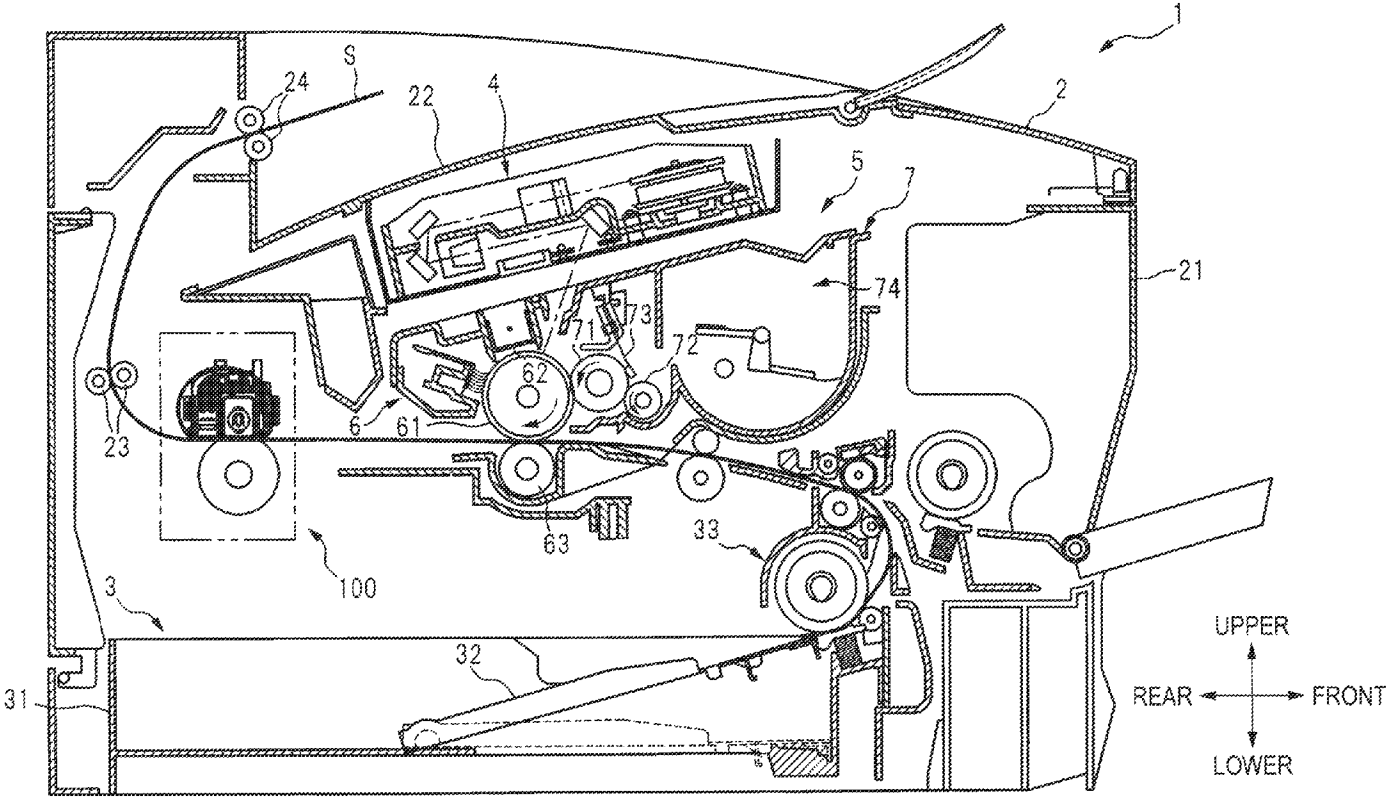
FIG. 1 shows a schematic configuration of an image forming apparatus including fixing de cc according to an exemplary embodiment of the invention.

It may be considered a configuration in which an upper frame covering an opposite side of the heating member to the pressing roller is provided so as to prevent heat of the heating member from escaping to an outside, separately from the support frame. However, when the upper frame is fixed so that it is put on the sidewalls of the support frame, the upper frame is inclined relative to the support frame due to manufacturing errors of the respective sidewalls. Thereby, it may be difficult to position the upper frame relative to the support frame with good precision.

Therefore, illustrative aspects of the invention provide technique for positioning two frames with good precision a fixing device including the two frames.

According to one illustrative aspect of the invention, there is provided a fixing device configured to heat-fix a developer image on a recording sheet. The fixing device comprises: a first fixing member and a second fixing member configured to form a nip portion heat-fixing the recording sheet; an urging mechanism comprising an urging member and is configured to urge the first fixing member toward the second fixing member by an urging force of the urging member; a first frame configured to support the second fixing member; a second frame that is arranged at an opposite side to the second fixing member with the first fixing member being interposed therebetween; and a switching member configured to apply a pressing force resisting the urging force of the urging member to the first fixing member for switching a width of the nip portion. The switching member comprises: a cam to which the urging force of the urging member is applied; and a shaft configured to support the cam. The first frame and the second frame are connected to each other by the shaft.

According thereto, since the first frame and the second frame are connected to each other by one shaft, it is possible to position the first frame and the second frame relative to the one shaft. Also, possible to reduce the number of parts, compared to a structure where a positioning shaft is separately provided from the switching member.

According to another illustrative aspect of the invention, the shaft is arranged at a first side of the first frame in a conveyance direction of the recording sheet, and a second side, which is opposite to the first side, of the first frame in the conveyance direction is provided with a restraint part configured to suppress the second frame from oscillating relative to the first frame about the shaft.

According thereto, it is possible to suppress the oscillation of the second frame about the shaft.

According to still another illustrative aspect of the invention, the first frame and the second frame are made of resin.

According thereto, it is possible to increase the degree of freedom of the shapes of the first and second frames.

According to still another illustrative aspect of the invention, the shaft is made of metal.

According thereto, since the two frames made of resin are connected by the metal shaft, it is possible to increase the rigidity of each frame.

According to still another illustrative aspect of the invention, the first frame comprises a first opening into which the shaft is inserted.

According to still another illustrative aspect of the invention, the first opening is a hole.

According to still another illustrative aspect of the invention, the first opening is a notched part in which a part of a hole is opened to an outside.

According to still another illustrative aspect of the invention, the cam comprises a cylindrical part made of resin and protruding axially, the shaft is configured to be inserted into the cylindrical part, and the cylindrical part is configured to be inserted into a hole of the first frame and to be rotatably supported by the corresponding hole.

According thereto the above configuration, since the cylindrical part of the cam made of resin slides relative to the first frame made of resin, it is possible to reduce the sliding resistance and thus to smoothly rotate the cam.

According to still another illustrative aspect of the invention, the second frame comprises a second opening into which the shaft is inserted.

According to still another illustrative aspect of the invention, the second opening is a hole.

According to still another illustrative aspect of the invention, the second opening is a notched part in which a part of a hole is opened to an outside.

According to still another illustrative aspect of the invention, the second opening is arranged at both end portions and a central portion of the second frame in an axial direction of the shaft.

According thereto, it is possible to securely suppress the bending of the second frame. Also, since it is possible to minimize a size of the connection part of the second frame with the shaft, it is possible to make the second frame light.

According to still another illustrative aspect of the invention, the second frame comprises: a conveyance roller configured to con convey the recording sheet; a bearing part configured to rotatably support the conveyance roller; a guide recess extending from an outer surface of the second frame toward the bearing part and configured to guide the conveyance roller to the bearing part; and an elastic member configured to urge the conveyance roller toward the bearing part. The shaft is disposed on a trajectory of the conveyance roller guided by the guide recess.

According thereto, since it is possible to suppress the conveyance roller from deviating from the second frame by the shaft, it is possible to reduce the number of parts, compared to a structure where a member for deviation prevention is separately provided from the shaft.

According to the illustrative aspects of the invention, it is possible to position two frames with good precision in a fixing device including the two frames.

EXEMPLARY EMBODIMENTS

Hereinafter, exemplary embodiments of the invention will be specifically described with reference to the drawings. In the below descriptions, a schematic configuration of an image forming apparatus 1 including a fixing device 100 according to an exemplary embodiment of the invention will be briefly described, and then a specific configuration of the fixing device 100 will be described. Incidentally, a laser printer is one example of the image forming apparatus 1.

Incidentally, in the below descriptions, the directions are described on the basis of a user who uses the image forming apparatus 1. That is, the right side of FIG. 1 is referred to as the 'front', the left side is referred to as the 'rear', the front side is referred to as the 'left' and the inner side is referred to as the 'right.' Also, the upper-lower direction of FIG. 1 is referred to as the 'upper-lower.'

(Schematic Configuration of Image Forming Apparatus)

As shown in FIG. 1, the image forming apparatus 1 includes, in a body housing 2, a feeder unit 3 that feeds a sheet S, which is one example of a recording medium, an exposure device 4, a process cartridge 5 that transfers a toner image (developer image) on the sheet S and a fixing device 100 that heat-fixes the toner image transferred on the sheet S.

The feeder unit 3 is provided at a lower part in the body housing 2. The feeder unit 3 includes a sheet feeding tray 31, a sheet pressing plate 32 and a sheet feeding mechanism 33. The sheet S accommodated in the sheet feeding tray 31 is upwardly inclined by the sheet pressing plate 32 and is fed toward the process cartridge 5 (e.g., between a photosensitive drum 61 and a transfer roller 63) by the sheet feeding mechanism 33.

The exposure device 4 is arranged at an upper part in the body housing 2. The exposure device 4 includes a laser emitting unit (not shown), a polygon mirror, a lens, a reflector and the like whose reference numerals are omitted. In the exposure device 4, a laser light (refer to the dotted-dashed line) based on image data, which is emitted from the laser emitting unit, is scanned on a surface of the photosensitive drum 61 at high speed, thereby exposing the surface of the photosensitive drum 61.

The process cartridge 5 is disposed below the exposure device 4. The process cartridge 5 is configured to be detachably mounted to the body housing 2 through an opening that is formed when a front cover 21 provided to the body housing 2 is opened. The process cartridge 5 includes a drum unit 6 and a developing unit 7.

The drum unit 6 includes the photosensitive drum 61, a charger 62 and the transfer roller 63. Also, the developing unit 7 is configured to be detachably mounted to the drum unit 6. The developing unit includes a developing roller 71, a supply roller 72, a layer thickness regulation blade 73 and a toner accommodation unit 74 that accommodates toner that is one example of developer.

In the process cartridge 5, the surface of the photosensitive drum 61 is uniformly charged by the charger 62 and then exposed by the high-speed scanning of the laser light emitted from the exposure device 4, so that an electrostatic latent image based on image data is formed on the photosensitive drum 61. Also, the toner in the toner accommodation unit 74 is supplied to the developing roller 71 via the supply roller 72, is introduced between the developing roller 71 and the layer thickness regulation blade 73, and is carried on the developing roller 71 as a thin layer having a predetermined thickness.

The toner carried on the developing roller 71 is supplied from the developing roller 71 to the electrostatic latent image formed on the photosensitive drum 61. Thereby, the electrostatic latent image becomes visible, and a toner image is thus formed on the photosensitive drum 61. Then, the sheet S is conveyed between the photosensitive drum 61 and the transfer roller 63, so that the toner image on photosensitive drum 61 is transferred onto the sheet S.

The fixing device 100 is arranged at the rear of the process cartridge 5. The toner image transferred on the sheet S passes through the fixing device 100, so that the toner image is heat-fixed on the sheet S. Then, the sheet S is discharged on a sheet discharge tray 22 by conveyance rollers 23, 24.

(Detailed Configuration of Fixing Device)

Figure 2:
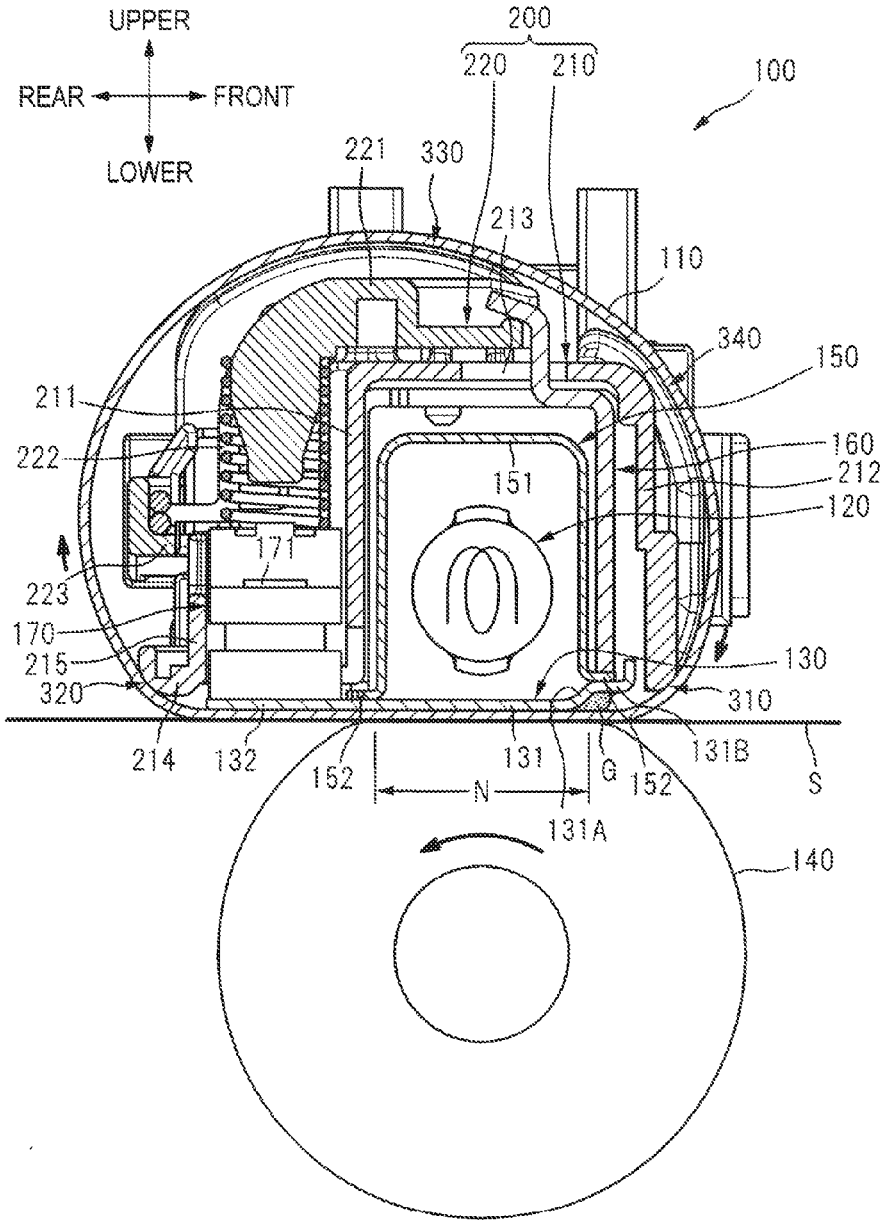
FIG. 2 is a sectional view of the fixing device.

As shown FIG. 2, the fixing device 100 includes a fixing belt 110, a halogen lamp 120, a nip plate 130 that is one example of a first fixing member, a pressing roller 140 that is one example of a second fixing member, a reflection member 150 and a stay 160.

The fixing belt 110 is a stainless steel belt of an endless shape (e.g., cylindrical shape) having heat resistance and flexibility. A rotation of the fixing belt 110 is guided by a guide part (e.g., a nip upstream guide 310, a nip downstream guide 320, an upper guide 330 and a front part guide 340) that is provided to a cover member 200. Here, the cover member 200 includes a first cover member 210 and a second cover member 220.

The first cover member 210 has a substantially U-shaped section and is elongated to extend in the left-right direction. The first cover member 210 is arranged to cover the stag 160 at an opposite side to the halogen lamp 120 with the stay 160 being interposed therebetween. The first cover member 210 includes a rear wall 211, a front wall 212, an upper wall 213 extending to connect upper ends of the rear wall 211 and the front wall 212, and an extension wall 214 extending rearward from a lower end of the rear wall 211.

A right end of the front wall 212 is formed with a front part guide 340 that guides a front part of the fixing belt 110, and a lower end of the front wall 212 is formed with a nip upstream guide 310 that guides a front lower part of the fixing belt 110. Also, a rear end of the extension wall 214 is formed with a nip downstream guide 320 that guides a rear lower part of the fixing belt 110.

The second cover member 220 has a substantially L-shaped section and is elongated to extend in the left-right direction. The second cover member 220 is arranged to cover parts of the rear wall 211 and upper wall 213 of the first cover member 210. The second cover member 220 includes an upper wall 221, a rear wall 222 extending downward from a rear end of the upper wall 221, and an extension wall 223 extending rearward from a lower end of the rear wall 222. The upper wall 221 is formed with an upper guide 330 that guide an upper part of the fixing belt 110.

The halogen lamp 120 is a member that generates radiation heat to thus heat the nip plate 130 and the fixing belt 110 (e.g., nip portion N), thereby heating the toner on the sheet S. The halogen lamp 120 is arranged at the inside of the fixing belt 110 at a predetermined interval from inner surfaces of the fixing belt 110 and the nip plate 130.

Figure 3:
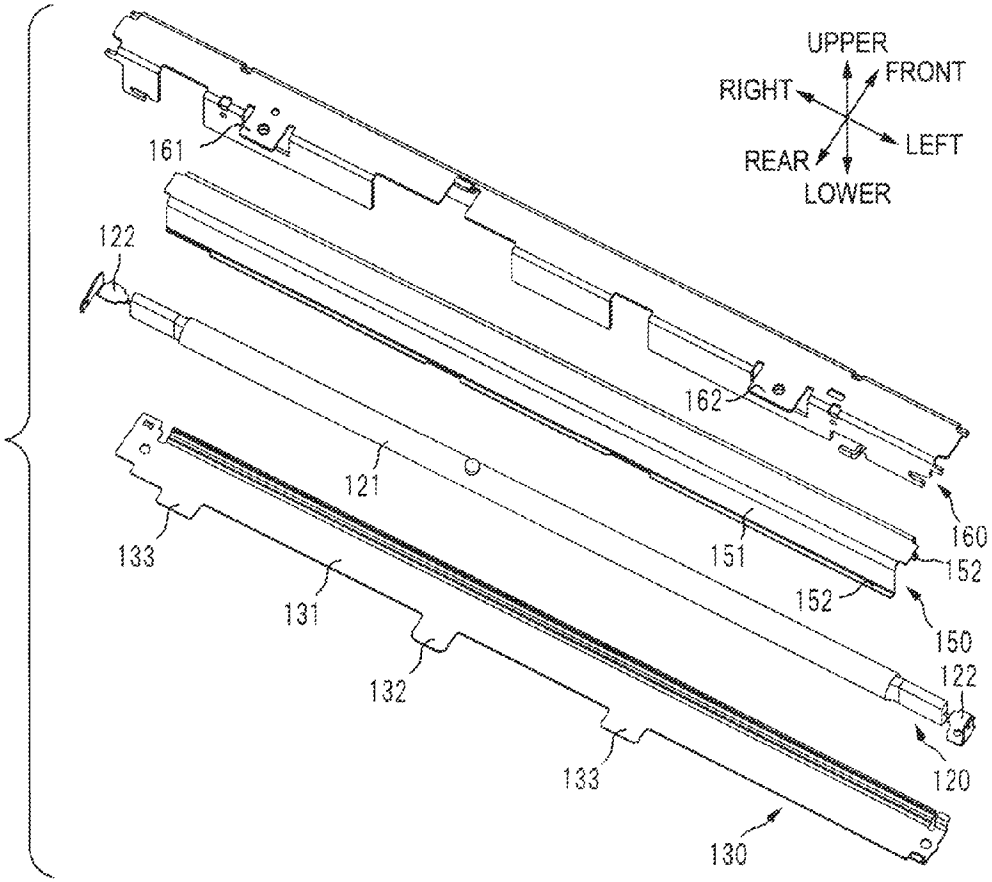
FIG. 3 is a perspective view of a nip plate, a halogen lamp, a reflection member and a stay.

As shown in FIG. 3, the halogen lamp 120 is formed by arranging a filament (not shown) in an elongated cylindrical glass tube 121, closing both longitudinal end portions of the glass tube 121 and enclosing inert gases including halogen element in the glass tube. A pair of electrodes 122 electrically connected to end portions of the filament in the glass tube 121 is provided on both longitudinal end portions of the halogen lamp 120.

Again referring to FIG. 2, the nip plate 130 is a plate-shaped member to which the radiation heat from the halogen lamp 120 is applied. A lower surface of the nip plate 130 is arranged to slidingly contact an inner peripheral surface of the fixing belt 110. In this exemplary embodiment, the nip plate 130 is made of metal, and for example is formed by bending an aluminum plate and the like having thermal conductivity higher than the stay 160 made of steel. Incidentally, when the nip plate 130 is made of aluminum, it is possible to improve the thermal conductivity of the nip plate 130.

As shown in FIG. 3, the nip plate 130 includes a base part 131, a first extension 132 and second extensions 133.

The base part 131 is a part that slidingly contacts an inner peripheral surface of the fixing belt 110 and extends in a conveyance direction of the sheet S to thus form a nip portion N. The base part 131 transfers heat from the halogen lamp 120 to toner on the sheet S via the fixing belt 110. As shown in FIG. 2, a bent portion 131A that is bent toward an inside (e.g., opposite side to the pressing roller 140-side) of the fixing belt 110 is formed at an upstream end portion of the base part 131 in the conveyance direction.

Thereby, it is possible to suppress the fixing belt 110 from being worn due to the friction with an end edge of the nip plate 130.

A flange portion 131B extending from the bent portion 131A toward an upstream side in the conveyance direction (e.g., an opposite side to the base part 131 in the conveyance direction) is formed at an upstream end portion of the bent portion 131A in the conveyance direction. A corner part between the bent portion 131A and the flange portion 131B is provided with lubricant G. Thereby, it is possible to further improve the sliding characteristic of the fixing belt 110 by the lubricant G.

As shown in FIG. 3, the first extension 132 and the second extension 133 have a flat plate shape, respectively, and are formed to extend rearward from a rear end of the base part 131. The one first extension 132, is formed near a center of the rear end of the base part 131 in the left-right direction, and a thermostat 170 (refer to FIG. 2) is arranged to face an upper surface of the first extension. Also, the second extensions 133 are respectively formed near the center and near a right end of the rear end of the base part 131 in the left-right direction, and two thermistors (not shown) are arranged to face upper surfaces of the second extensions.

As shown in FIG. 2, the pressing roller 140 is a member forming the nip portion N between the fixing belt 110 and the pressing roller by interposing the fixing belt 110 between the nip plate 130 and the pressing roller. The pressing roller 140 is disposed below the nip plate 130. In this exemplary embodiment, in order to form the nip portion N, one of the nip plate 130 and the pressing roller 140 is urged toward the other. The pressing roller 140 is configured to rotate with the fixing belt 110 being positioned between the nip plate 130 and the pressing roller, thereby conveying the sheet S together with the fixing belt 110.

The pressing roller 110 is configured to rotate as a driving force is transferred thereto from a motor (not shown) provided in the body housing 2. As the pressing roller rotates, it rotates the fixing belt 110 by a frictional force with the fixing belt 110 (or sheet S). As the sheet S having the toner image transferred thereto is conveyed between the pressing roller 140 and the heated fixing belt 110 at the nip portion N), the toner image is heat-fixed.

The reflection member 150 is a member that reflects the radiation heat from the halogen lamp 120 toward the nip plate 130. The reflection member 150 is arranged at a predetermined interval from the halogen lamp 120 so that the reflection member surrounds (covers) the halogen lamp 120 at the inside of the fixing belt 110.

The reflection member 150 is formed by bending an aluminum plate and the like having high reflectance of the infrared and far-infrared into a substantial U shape, when seen from the section. More specifically, the reflection member 150 includes a reflection part 151 having a bent shape and flange parts 152 extending from front and rear end portions of the reflection part 151 toward the outside in the front-rear direction.

The stay 160 is a member that supports the front and rear end portions of the nip plate 130 (e.g., base part 131) via the reflection member 150 (e.g., flange parts 152) to thus bear load applied from the pressing roller 140. The stay 160 is arranged to cover the reflection member 150 at the inside of the fixing belt 110. Incidentally, in the configuration in which the nip plate 130 urges the pressing roller 140, the load means a reactive force of the force with which the nip plate 130 urges the pressing roller 140.

The stay 160 is formed by bending, for example, a steel plate having relatively high rigidity into a substantially U-shaped section conforming to an outer surface shape of the reflection member 150 (reflection part 151). As shown in FIG. 3, the stay 160 includes a right fixation part 161 provided at a right side thereof and a left fixation part 162 provided at a left side. The right fixation part 161 and the left fixation part 162 are formed to extend rearward from an upper wall part of the stay 160 and include a penetrated screw hole (reference numeral thereof is omitted), respectively.

Figure 4:
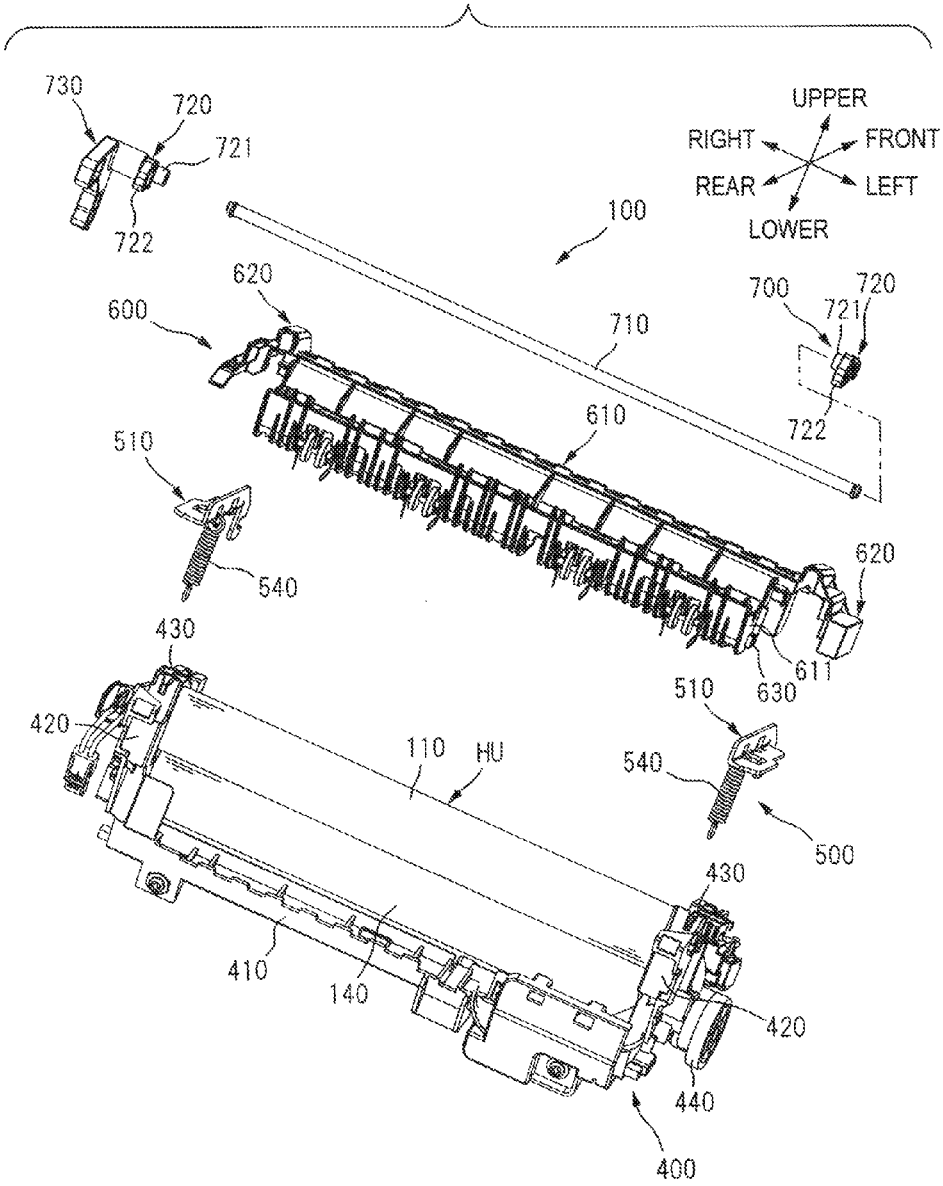
FIG. 4 is an exploded perspective view of the fixing device.

Also, as shown in FIG. 4, the fixing device 100 includes a first frame 400, an urging mechanism 500, a second frame 600 and a switching member 700 in addition to the above members.

The first frame 400 is a frame made of resin. The first frame 400 includes a lower wall part 410 and a pair of sidewalls 420 protruding upward from both ends of the lower wall part 410 in the left-right direction.

The pair of sidewalls 420 rotatably supports the pressing roller 140 at lower parts thereof and slidably supports a heating unit HU in the upper-lower direction at upper parts thereof. Here, the heating unit HU has not only a structure configured by the fixing belt 110, the halogen lamp 120, the nip plate 130, the reflection member 150, the stay 160 and the cover member 200 but also a side guide (not shown) that supports both left and right ends of the structure (for example, the stay 160) and guides both left and right end portions of the fixing belt 110.

The side guide is slidably supported to the pair of side walls 420, so that the heating unit HU can move in the upper-lower direction. Also, the left sidewall 420 is provided with a driving gear 440 for driving the pressing roller 140.

Specifically, the driving gear 440 is integrally provided to the left end of the pressing roller 140 and is configured to integrally rotate with the pressing roller 140 as a driving force from a motor (not shown) is applied thereto. Also, the pair of sidewalls 420 is provided with the urging mechanism 500.

The urging mechanism 500 is a mechanism for urging the heating unit HU (e.g., nip plate 130) toward the pressing roller 140. The urging mechanism 500 includes a pair of arm members 510 and a pair of tension coil springs 540 that is one example of an urging member.

Figure 5A:
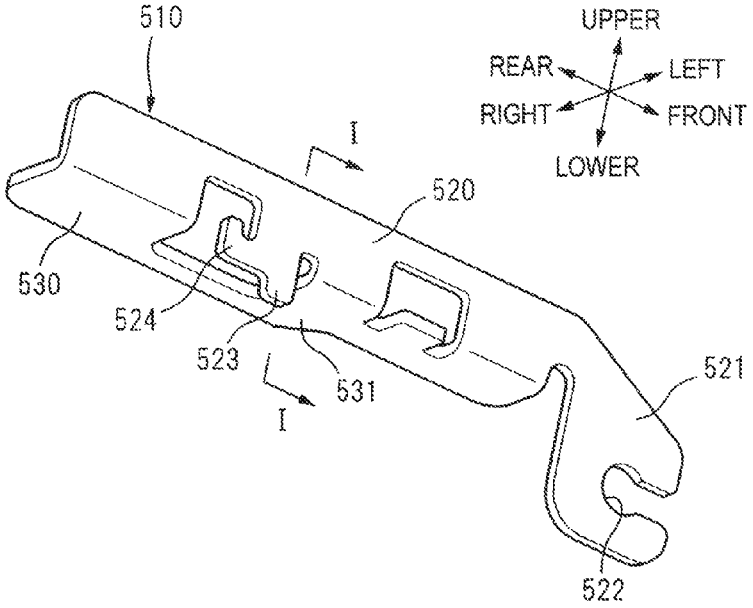
FIG. 5A is a perspective view of an arm member.
Figure 5B:
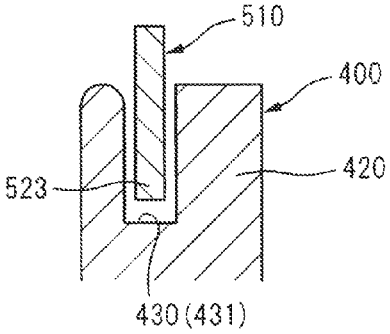
FIG. 5B is a schematic sectional view showing a relation between the arm member and a recess.

The pair of arm members 510 is arranged at upper parts of both left and right end portions of the heating unit HU and is bilaterally symmetric. As shown in FIG. 5A, the arm member 510 extends in the front-rear direction and has an L-shaped section by plate-shaped vertical wall part 520 and horizontal wall part 530.

The vertical wall part 520 is a wall orthogonal to the left-right direction. A first extension 521 extending downward is formed at a front end portion of the vertical wall part 520. The first extension 521 is formed with a rotation center hole 522 in which a shaft (not shown) of the sidewall 420 of the first frame 400 is rotatably supported. Thereby, a rear end portion of the arm member 510 can vertically oscillate about the rotation center hole 522.

Also, the vertical wall part 520 is formed at a rear side thereof with a second extension 523 protruding more downward than the horizontal wall part 530. As shown in FIGS. 4 and 5A, the second extension 523 is inserted into a recess 430 of each sidewall 420 of the first frame 400. The recess 430 is opened upward and includes a bottom surface 431 facing the second extension 523 of the arm member 510 in the upper-lower direction (e.g., urging direction of the tension coil spring 540, which will be described later).

Thereby, when a lower end of the second extension 523 contacts the bottom surface 431 of the recess 430, the arm member 510 is restrained from moving downward, so that the heating unit HU is not further lowered downward.

Also, the second extension 523 is formed at a rear side thereof with a hook part 524 that extends rearward and is then bent upward. The tension coil spring 540 is provided between the hook part 524 and the sidewall 420 of the first frame 400, so that a rear end part (specifically, an opposite side to a rotational shaft with a pressing part 531 of the arm member 510 being interposed therebetween) of the arm member 510 is urged toward the first frame 400.

The horizontal wall part 530 is a wall orthogonal to the upper-lower direction. The horizontal wall part 530 includes, at its substantially central part, a pressing part 531 for pressing the heating unit HU. The pressing part 531 is arranged at an outer side of the hook part 524 in the left-right direction. In other words, the tension coil spring 540 is arranged at an inner side (e.g., widthwise inner side of the sheet S) of the pressing part 531 in the left-right direction.

Thereby, a force that is applied from the urging mechanism 500 to the pair of sidewalk 420 of the first frame 400 is generated toward the inner sides thereof in the left-right direction.

Incidentally, the heating unit 11U is supported to the arm member 510 (pressing part 531), and the heating unit HU is moved in the upper-lower direction as the arm member 510 is moved in the upper-lower direction.

As shown in FIG. 4, the second frame 600 is a frame made of resin and having a long shape extending in the left-right direction. The second frame 600 is arranged at an opposite side to the pressing roller 140 with the heating unit HU being interposed therebetween and is provided to extend over the pair of sidewalls 420 of the first frame 400. The second frame 600 includes a main body part 610 having a long shape and cover parts 620. The cover parts 620 protrudes from front-upper parts of left and right side surfaces 611 of the main body part 610 toward the outside in the left-right direction.

The main body part 610 is formed to be shorter than a distance between the pair of sidewalk 420 and is thus inserted between the pair of sidewalls 420. The left and right side surfaces 611 of the main body part 610 are formed at rear-lower parts thereof with protrusions 630 protruding toward the outside in the left-right direction (e.g., widthwise outer side of the conveyance S).

Figure 6A:
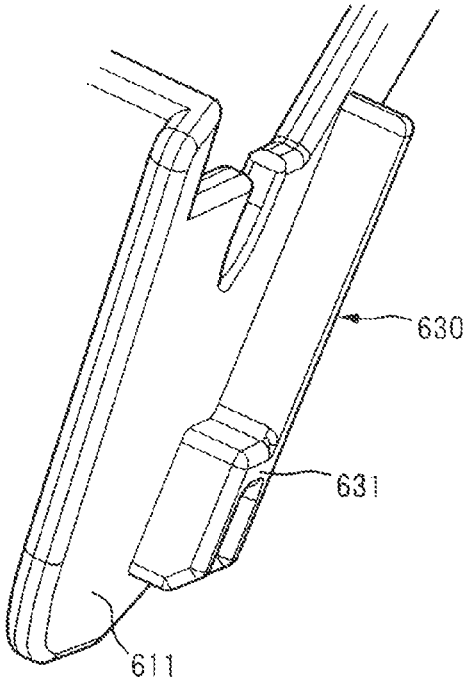
FIG. 6A is an enlarged perspective view of a protrusion.

The protrusions 630 are arranged at the inside of the sidewalls 420 in the left-right direction. As shown in FIG. 6A, the protrusions 630 have a leading end face 631, respectively, which is formed to have a height with being arranged at an interval from each of the sidewalls 420. Thereby, when the pair of sidewalk 420 is pushed and bent inward in the left-right direction by the urging mechanism 500, the sidewalls 420 are brought into contact with the leading end faces 631, thereby suppressing the deformation of the sidewalls 420. That is, in this exemplary embodiment, the leading end faces 631 of the protrusions 630 serve as restraint surfaces that restrain the deformation of the sidewalls 420.

The deformation of the sidewalls 420 is suppressed as described above, so that a position of the driving gear 440 provided to the sidewall 420 is suppressed from being deviated in the left-right direction. Therefore, it is possible to securely operate the driving gear 440. Also, since the gaps are formed between the pair of sidewalls 420 and the leading end faces 631, it is possible to easily assemble the first frame 400 and the second frame 600.

Figure 6B:
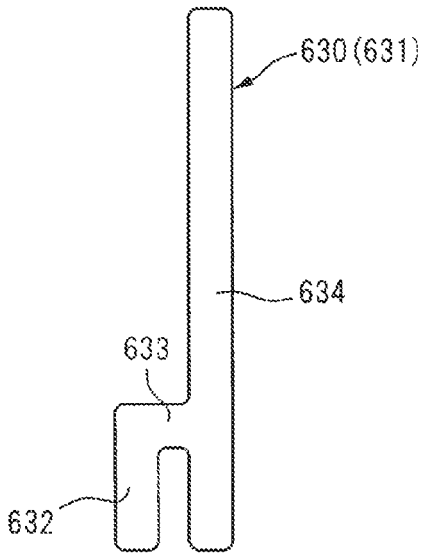
FIG. 6B is a side view thereof.

Also, as shown in FIG. 6B, the protrusion 630 includes a first plate-shaped part 632, a second plate-shaped part 633 orthogonal to (intersecting with) the first plate-shaped part 632, and a third plate-shaped part 634 orthogonal to the second plate-shaped part 633 and the protrusion 630 is configured to have an h shape by the plate-shaped parts 632 to 634. Thereby, since it is possible to improve the rigidity of the protrusion 630, it is possible to securely suppress the deformation of each sidewall 420 by the protrusion 630. Also, since the protrusion is formed by the respective plate shaped-parts 632 to 634, i.e., the protrusion is configured to have a thin structure, it is possible to make the second frame 600 light.

Figure 7:
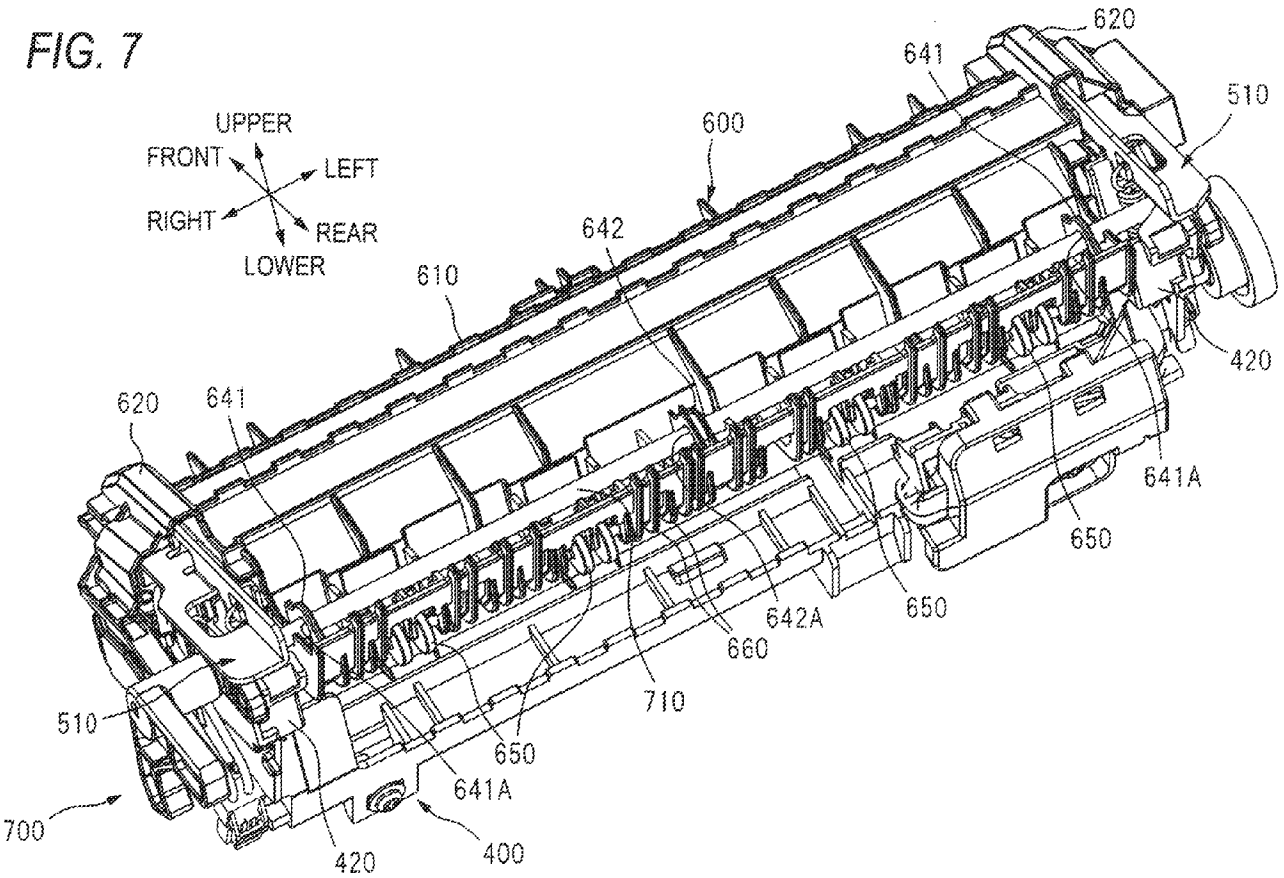
FIG. 7 is a perspective view of the fixing device, which is obliquely seen from the upper-rear.

As shown in FIG. 7, the first frame 400 and the second frame 600 are connected to each other by one shaft 710 of the switching member 700, which will be described later. Thereby, it is possible to position the first frame 400 and the second frame 600 relative to the one shaft 710 with good precision. Also, it is possible to reduce the number of parts, compared to a structure where a positioning shaft is separately provided from the shaft 710 of the switching member 700.

The shaft 10 extends from one end side to the other end side in the left-right direction of the second frame 600 and penetrates the pair of sidewalk 420 of the first frame 400 and the second frame 600. Thereby, since the second frame 600 is reinforced by the shaft 710 and the bending of the second frame 600 is thus suppressed, it is possible to securely suppress the deformation of the sidewalls 420 by the leading end faces 631 of the protrusions 630. Also, since the shaft 710 of the switching member 700 is used for reinforcement of the second frame 600, it is possible to reduce the number of parts, compared to a structure where a shaft for reinforcement is separately provided.

In this exemplary embodiment, the shaft 710 is made of metal. Thereby, while the two frames 400, 600 are made of resin and the degree of freedom of the shapes thereof is thus increased, it is possible to improve the rigidity of the frames 400, 600 made of resin by the shaft 710 made of metal.

The second frame 600 is formed at an upper-rear side thereof with three parts to be supported 641, 642, which are supported by the shaft 710. Two parts to be supported 641 are provided at both end portions of the second frame 600 in the left-right direction (e.g., axial direction of the shaft 710) and have one plate shape, respectively. The two parts to be supported 641 are formed with penetration holes 641A, respectively, which are one example of a second opening into which the shaft 710 is inserted.

One part to be supported 642 is provided at a central portion of the second frame 600 in the left-right direction and is configured by integrally connecting two plate-shaped ribs with a connection part having a diameter larger than the shaft 710. The part to be supported 642 is formed with a penetration hole 642A, which is one example of a second opening into which the shaft 710 is inserted.

Here, the central portion of the second frame 600 may be an exactly central portion of the second frame 600 in the left-right direction, as shown, or may be deviated leftward or rightward from the central portion.

The three parts to be supported 641, 642 are arranged as described above, so that it is possible to securely suppress the bending of the second frame 600 by the shaft 710. Also, since it is possible to minimize a size of the connection part of the second frame 600 with the shaft 710, it is possible to make the second frame 600 light.

Also, the left-right width of the part to be supported 642 provided to the central portion of the second frame 600 is made to be larger than the left-right width of each part be supported 641 provided to both end portions. Accordingly, it is possible to securely suppress the bending of the central portion of the second frame 600.

Figure 8A:
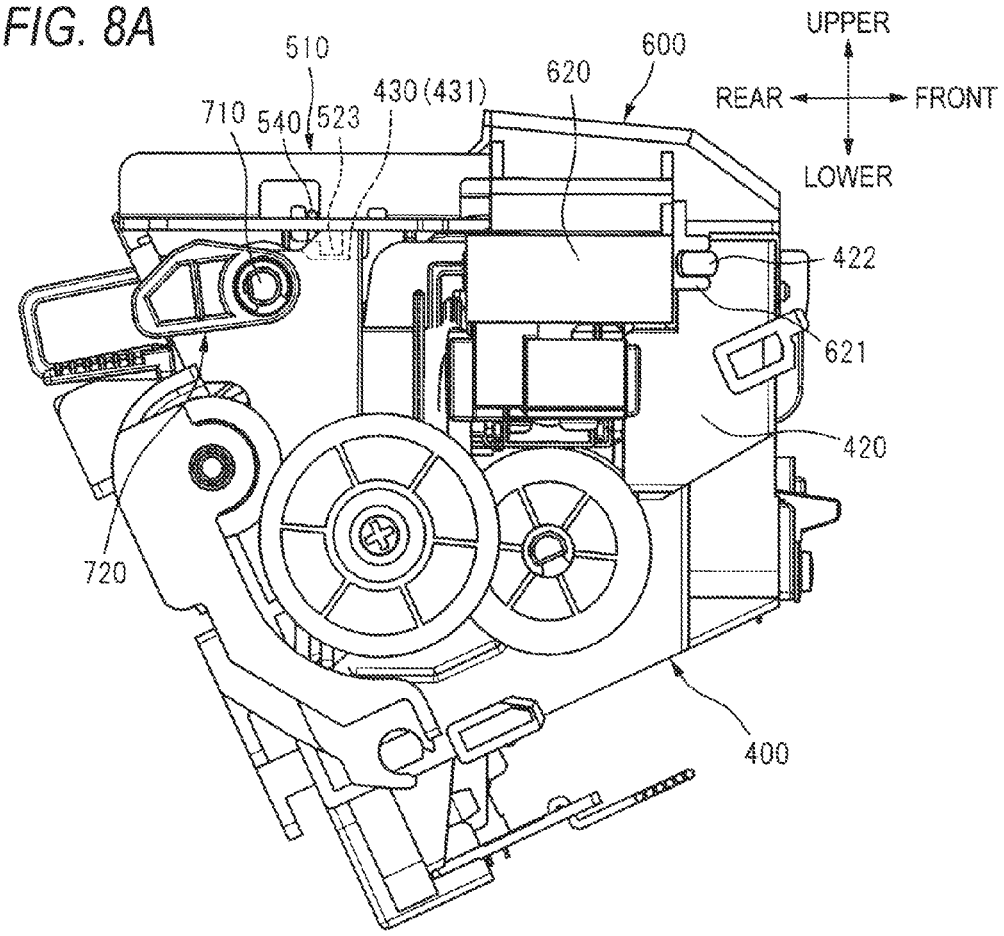
FIG. 8A is a side view of the fixing device.
Figure 8B:
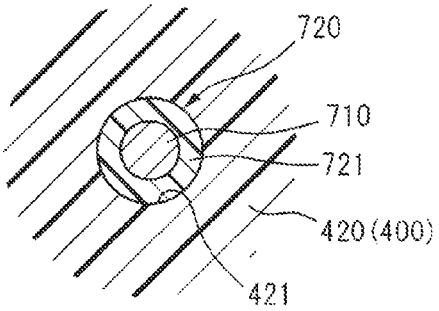
FIG. 8B is a schematic sectional view of a sidewall, which is taken in the vicinity of a shaft.

Also, as shown in FIGS. 8A and 8B, the upper parts of the rear sides (e.g., one side of the sheet S in the conveyance direction) of the sidewalls 420 of the first frame 400 are formed with through-holes 421, which are one example of a first opening into which the shaft 710 is inserted. The shaft 710 penetrates the rear part of the first frame 400 and the rear part of the second frame 600, as described above, so that the front part of the second frame 600 may be able to oscillate about the shaft 710. However, the oscillation is suppressed by protrusions 422 and engaging recess portions 621 provided to the front part of the first frame 400 and the front part of the second frame 600.

Specifically, the protrusions 422, which are one example of a restraint part, are formed on the upper parts of the front sides (e.g., the other side of the sheet S in the conveyance direction) of the sidewalls 420 of the first frame 400 so that they protrude outward in the left-right direction.

The engaging recess portions 621 are formed on the front sides of the cover parts 620 of the second frame 600. Specifically, as shown in FIG. 7, the cover parts 620 extend outward from both left and right ends of the main body part 610 in the left-right direction, pass over the sidewalls 420, and are then bent downward to thus face the outer surfaces of the sidewalls 420, such that the cover parts 620 cover the vicinity of the rotational shaft of the arm members 510. Also, as shown FIG. 8A, the engaging recess portions 621 are formed on the front sides of the cover parts 620 facing the outer surfaces of the sidewalls 420.

The engaging recess portion 621 is a recess portion that is opened forward. The engaging recess portion 621 is engaged with the protrusion 422 so that the protrusion 422 is held therein in the upper-lower direction. Incidentally, when mounting the first frame 400 and the second frame 600 configured as described above, the pair of cover parts 620 of the second frame 600 is first slid along the upper surfaces of the pair of the sidewalls 420 of the first frame 400, so that the pair of engaging recess portions 621 is engaged with the pair of protrusions 422.

Then the shaft 710 is inserted into the respective through-holes 421 of the first frame 400 and the respective through-holes 641A, 642A of the second frame 600. Thereby, the second frame 600 is mounted to the first frame 400. More specifically, cams 720 that will be described later are attached to both ends of the shaft 710 inserted into the respective through-holes 641A, 642A, so that the second frame 600 is mounted to the first frame 400.

As shown in FIG. 7, the rear-upper part of the second frame 600 is provided with a plurality of conveyance rollers 650 for conveying the sheet S at an interval iii the left-right direction, and is also provided with a plurality of guide ribs 660 for guiding the sheet S at an interval in the left-right direction so that each conveyance roller 650 is positioned therebetween in the left-right direction.

Figure 9:
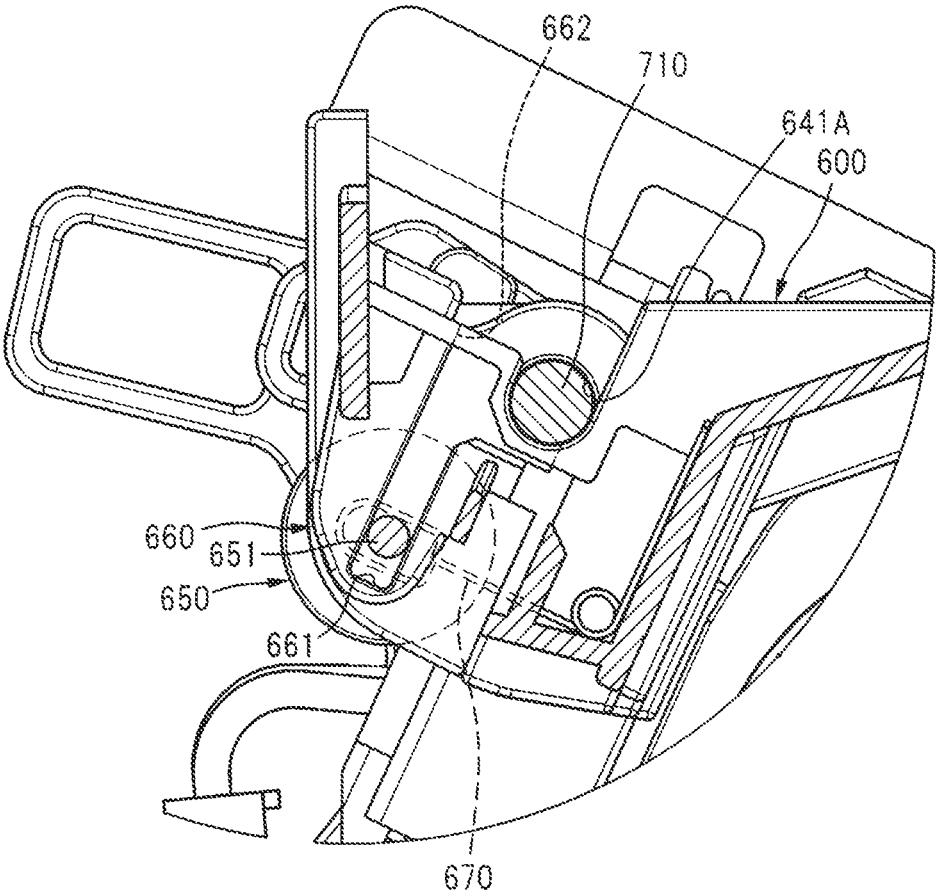
FIG. 9 is an enlarged sectional view showing a structure in the vicinity of a conveyance roller.

As shown in FIG. 9, the guide ribs 660 that are disposed at both left and right sides of the conveyance roller 660 are respectively formed with a recess-shaped bearing part 661 having a substantially U shape and rotatably supporting a rotational shaft part 651 of the conveyance roller 650 and a guide recess 662 for guiding the conveyance roller 650 into the bearing part 661. The guide recess 662 is a recess extending from the bearing part 661 to the upper surface (e.g., outer surface) of the second frame 600, and a part adjacent to an upper surface thereof is formed to be wider than the bearing part 661, so that the guide recess communicates with a space of the upper part of the second frame 600.

Thereby, it is possible to easily insert the rotational shaft part 651 of the conveyance roller 650 into the guide recesses 662 (e.g., wider parts). Also, when the rotational shaft part 651 of the conveyance roller 650 is being inserted along the guide recesses 662, the rotational shaft part 651 is guided to the bearing parts 661 by the guide recesses 662, so that the conveyance roller 650 can be mounted to the second frame 600.

When the shaft 710 is inserted into the respective through-holes 421, 641A, 642A of the respective frames 400, 600 after the conveyance roller 650 is mounted to the second frame 600, the shaft 710 is disposed on a trajectory of the conveyance roller 650 moving along the guide recesses 662. Thereby, since it is possible to suppress the conveyance roller 650 from deviating from the second frame 600 by the shaft 710, it is possible to reduce the number of parts, compared to a structure where a member for deviation prevention is separately provided from the shaft 710.

Also, a torsion spring 670, which is one example of an elastic member, urging the conveyance roller 650 toward the bearing part 660, specifically, toward a bottom surface of the bearing part 661 having a U shape is provided in the vicinity of the bearing part 661 of the second frame 600. Thereby, since the conveyance roller 650 is urged toward a driving roller (not shown) disposed below the conveyance roller 650 by the torsion spring 670, it is possible to enable the conveyance roller 650 to follow the driving roller.

As shown in FIG. 4, the switching member 700 includes the shaft 710 and a pair of cams 720 that is fixed (supported) to both end portions of the shaft 710. The shaft 710 is rotatably supported to the first frame 400 and the second frame 600. Thereby, the pair of cams 720 provided to both end portions of the shaft 710 is rotated relative to the respective frames 400, 600 together with the shaft 710.

The cam 720 is a member that is made of resin and can adjust a width of the nip portion by pressing upward the arm member 510 against the urging force of the tension coil spring 540. The cam 720 is disposed below the arm member 510. The cam 720 includes a cylindrical part 721, into which the shaft 710 is inserted, and a plate earn part 722 that extends outward from the cylindrical part 721 in a diametrical direction.

The cylindrical part 721 protrudes inward (e.g., inner side in the axial direction) from the plate cam part 722 in the left-right direction, and is inserted into the through-hole 421 of the sidewall 420 of the first frame 400 and thus is rotatably supported therein, as shown in FIG. 8B. Thereby, since the cylindrical part 721 of the cam 720 made of resin slides relative to the first frame 200 made of resin, it is possible to reduce the sliding resistance and to thus smoothly rotate the cam 720.

Figure 10A:
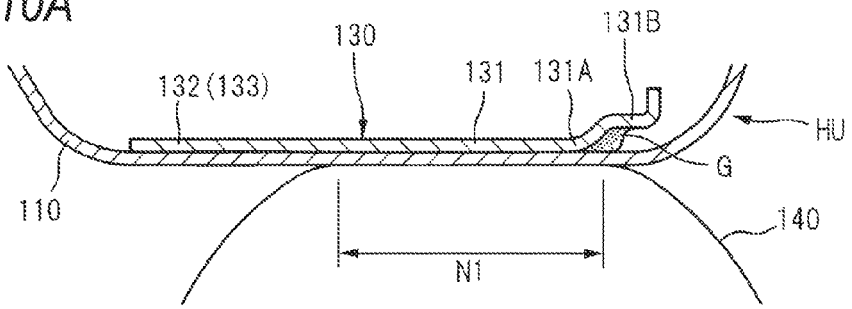
FIGS. 10A to 10C illustrate states of a nip portion, which are switched by a switching member.
Figure 10B:
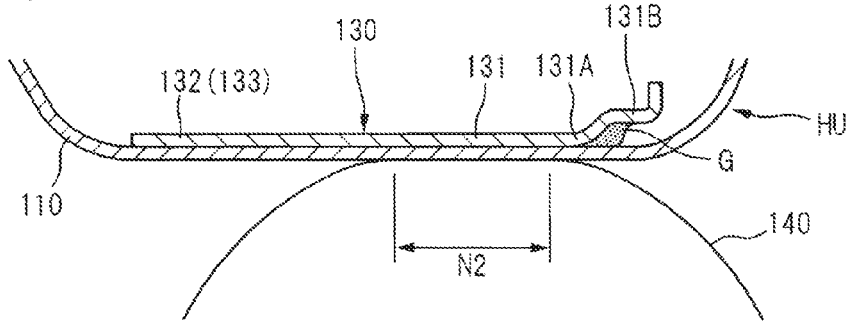
Figure 10C:
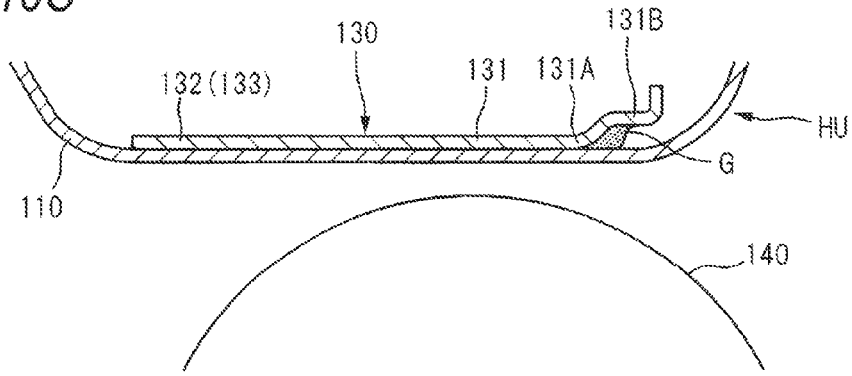

Also, as shown in FIG. 4, an operation part 730, which is operated by a user, is integrally provided to an outer side of the right cam 720 in the left-right direction. When a user operates the operation part 730, it is possible to switch the nip width in three stages, as shown in FIGS. 10A to 10C. Here, FIG. 10A shows a first nip width N1 at the time of printing a normal sheet and the like, FIG. 10B shows a second nip width N2 smaller than the first nip width N1, which is a nip width at the time of printing a cardboard and the like, and FIG. 10C shows a state (nip width=0) where the heating unit HU is separated from the pressing roller 140. Here, in FIG. 10A to 10C, the cover member 200 and the like are omitted for convenience.

Incidentally, the 'first nip width N1' and the 'second nip width N2' have an allowance (tolerance) regarding a design value, to some extent.

Specifically, in the state of the first nip width N1 shown in FIG. 10A, the cam 720 is distant from the arm member 510 (refer to FIG. 11A), i.e., the cam 720 is not applied with the urging force of the tension coil spring 540. From this state (hereinafter, referred to as the 'first direction'), when the cam 720 is unidirectionally rotated into a second direction by the operation of the operation part 730, as shown in FIG. 11B, the arm member 510 is pushed up by a predetermined amount. That is, when the pressing force resisting the urging force of the tension coil spring 540 is applied to the heating unit HU, the heating unit HU is moved from the lowest first position to an upper second position. Thereby, as shown in FIG. 10B, the width of the nip portion is switched from the first nip width N1 to the second nip width N2.

Figure 11A:
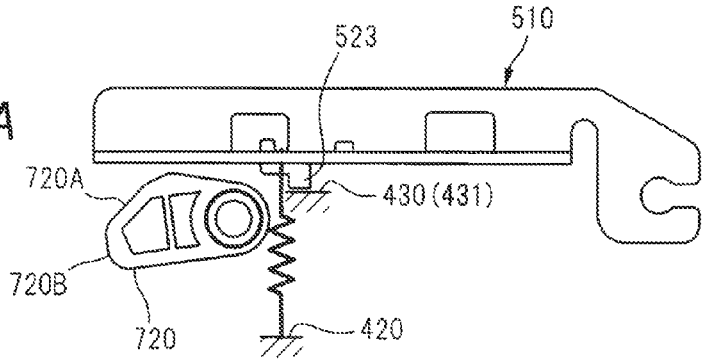
FIGS. 11A to 11C illustrate a relation between a cam and an arm member.
Figure 11B:
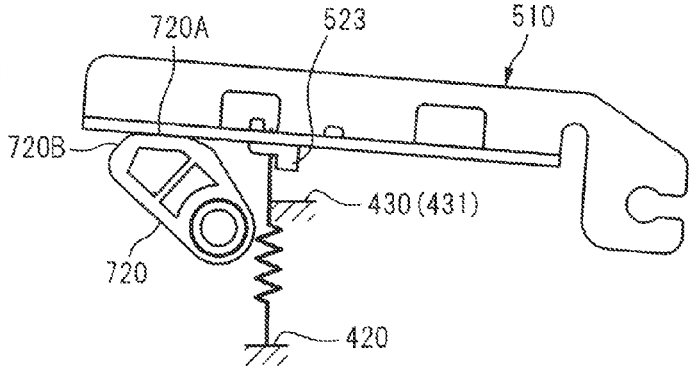
Figure 11C:
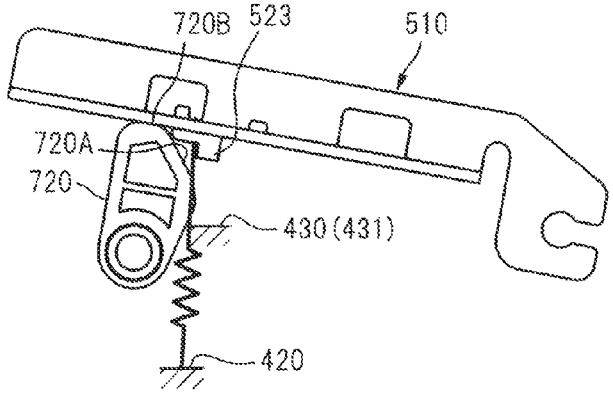

Also, when switching the width of the nip portion from the second nip width N2 to zero, the cam 720 is unidirectionally rotated by a predetermined amount from the second direction to a third direction by the operation of the operation part 730, as shown in FIG. 11C, so that the arm member 510 is further pushed up. Thereby, the heating unit HU is moved to the uppermost third position, so that the nip width becomes zero (refer to FIG. 10C).

Here, when the nip width is the second nip width N2 or zero, the cam 720 is applied with the urging force of the tension coil spring 540 via the arm member 510, as shown in FIGS. 11B and 11C. Incidentally, at each state of the second nip width N2 and the separated state, the direction of the cam 720 is kept as a first release surface 720A and a perfect release surface 7203 of the can 720, which have a planar shape, respectively, are surface-contacted to the arm member 510.

When switching the width of the nip portion from zero to the second nip width N2, the cam 720 is rotated in the other direction by a predetermined amount from the third direction to the second direction by the operation of the operation part 730, so that the arm member 510 is pushed down by a predetermined amount by the urging force of the tension coil spring 540 (refer to FIG. 11B). Thereby, the heating unit HU is moved from the uppermost third position to the second position, so that the width of the nip portion is switched from zero to the second nip width N2.

When switching the width of the nip portion from the second nip width N2 to the first nip width N1, the cam 720 is rotated in the other direction by a predetermined amount from the second direction to the first direction by the operation of the operation part 730, so that the pressing force being applied to the arm member 510 from the earn 720 is released (refer to FIG. 11A). Thereby, the heating unit HU is moved from the second position to the lowest first position, so that the width of the nip portion is switched from the second nip width N2 to the first nip width N1.

Here, when the width of the nip portion is the first nip width N1, the arm member 510 is not supported by the cam 720. Thus, when the pressing roller 140 softens due to environment conditions such as temperature and humidity, the heating unit HU is lowered below the first position, so that the first nip width N1 may exceed a maximum value of an allowed range. Therefore, in this exemplary embodiment, the bottom surface 431 of the recess 430 is formed at a position corresponding to a maximum value of the first nip width N1.

Figure 12A:
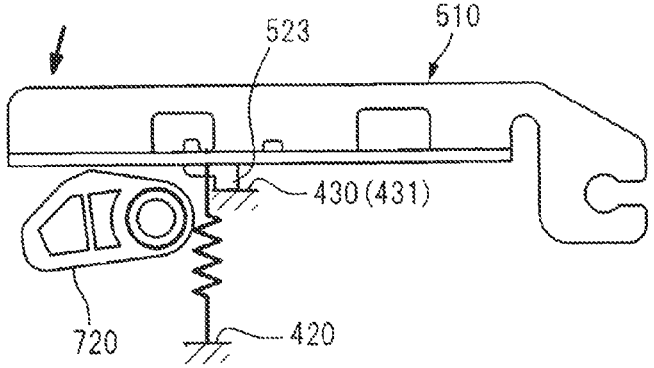
FIG. 12A illustrates a state where the arm member contacts a bottom surface of a recess.

Thereby, at the state where the pressing force being applied to the arm member 510 from the earn 720 is released, even when the pressing roller 140 softens due to environment conditions such as temperature and humidity and the heating unit HU is thus about to be lowered below the first position, the arm member 510 is brought into contact with the bottom surface 431 of the recess 430, as shown in FIG. 12A, so that the moving of the heating unit HU is restrained. Thereby, as shown in FIG. 12B, it is possible to prevent the width of the nip portion from exceeding the maximum value Nmax of the first nip width N1 and to thus secure the appropriate fixing performance.

Figure 12B:
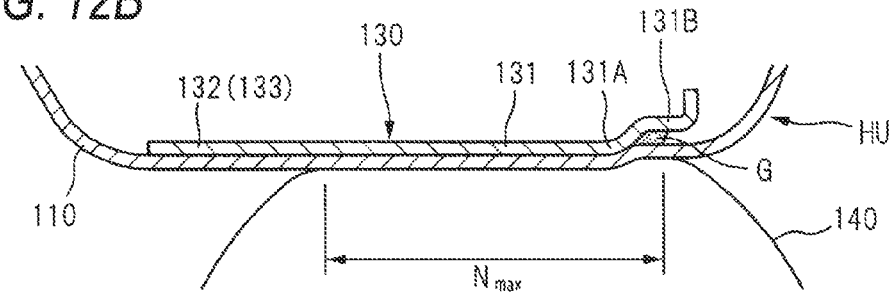
FIG. 12B illustrates a state where a width of the nip portion becomes a maximum value of a first nip width.

Also, the bottom surface 431 of the recess 430 is provided at a position at which a gap is formed between the fixing belt 110 and the flange portion 131E of the nip plate 130 when the moving of the heating unit HU is restrained by the contact with the arm member 510 (refer to FIG. 12B). Thereby, the fixing belt 110 is not contacted to the flange portion 131B, so that the lubricant G at the corner part between the bent portion 131A and the flange portion 131B is suppressed from being moved to the fixing belt 110 beyond necessity. Therefore, it is possible to securely keep the lubricant G at the corner part, so that it is possible to use the lubricant G for a long time.

Also, the bottom surface 431 of the recess 430 is provided at a position at which the fixing belt 110 does not contact edges of the extensions 132, 133 when the moving of the heating unit HU is restrained by the contact with the arm member 510. That is, the moving of the arm member 510 and further the heating member HU is stopped by the bottom surface 431 of the recess 430 so that the edges of the extensions 132, 133 do not enter the range of the nip portion. Thereby, it is possible to suppress the deterioration of the fixing belt 110 due to the sliding contact of the fixing belt 110 with the edges of the extensions 132, 133.

Also, the switching member 700 is configured so that the fixing belt 110 does not contact the bent portion 131A of the nip plate 130 when the width of the nip portion is the second nip width N2. That is, at a state where the arm member 510 is supported by the cam 720 so that the width of the nip portion is the second nip width N2, the switching member 700 is configured so that the bent portion 131A does not enter the range of the nip portion.

Thereby, even when the fixing belt 110 contacts the bent portion 131A (for example, the nip width is the maximum value Nmax of the first nip width N1) at the state where the nip width is the first nip width N1, the fixing belt 110 does not contact the bent portion 131A at the state where the nip width is the second nip width N2. Therefore, it is possible to suppress the deterioration of the fixing belt 110 when the nip width is the second nip width N2.

Modifications to Exemplary Embodiments

Although the exemplary embodiment of the invention has been described, it should be understood that the invention is not limited to the exemplary embodiment. The specific configuration can be appropriately changed without departing from the scope of the invention.

Figure 13:
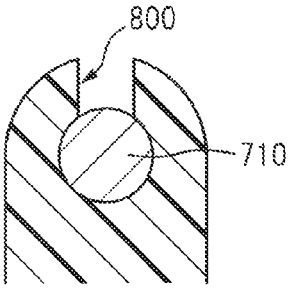
FIG. 13 shows a modified embodiment of a shaft supporting part.

In the above-described exemplary embodiment, the holes have been exemplified as the first opening and the second opening. However, the invention is not limited thereto. For example, the first opening and the second opening may be a notched part 800 in which a part of the outer periphery of the hole, into which the shaft 710 is inserted, is opened to the outside, as shown in FIG. 13.

In the above-described exemplary embodiment, the protrusion 422 has been exemplified as the restraint part. However, the invention is not limited thereto. For example, the restraint part may be a recess part.

In the above-described exemplary embodiment, the torsion spring 670 has been exemplified as the elastic member. However, the invention is not limited thereto. For example, the elastic member may be a wire spring or plate spring.

In the above-described exemplary embodiment, the nip plate 130 is the first fixing member and the pressing roller 140 is the second fixing member. However, the invention is not limited thereto. For example, the pressing roller may be the first fixing member and the nip plate may be the second fixing member. Also, the heating roller may be the first fixing member and the pressing roller may be the second fixing member.

In the above-described exemplary embodiment, the urging mechanism 500 is configured by the arm member 510 and the tension coil spring 540. However, the invention is not limited thereto. For example, the urging mechanism may be configured by the arm member and the torsion spring or may be configured only by the urging member such as tension coil spring or torsion spring.

In the above-described exemplary embodiment, the fixing belt 110 (e.g., cylindrical member) is made of stainless steel. However, the invention is not limited thereto. For example, the fixing belt may be formed of other metals, may be formed of resin such as polyimide resin and the like, or may be formed of a material having elasticity such as rubber. When the fixing belt is made of resin, it is possible to reduce the sliding resistance between the fixing belt 110 and the nip plate 130 made of metal and thus to further improve the sliding characteristic of the fixing belt 110.

Also, the cylindrical member may have a multi-layered structure. Specifically, the fixing belt may have a structure where a resin layer and the like for reducing the sliding resistance is provided on a surface of a metal belt, or may have a structure where an elastic layer such as rubber is provided on a surface of a metal belt.

In the above-described exemplary embodiment, the upstream end portion of the nip plate 130 in the conveyance direction is bent inward. However, the invention is not limited thereto. For example, the downstream end portion of the nip plate 130 in the conveyance direction may be bent.

In the above-described exemplary embodiment, the sheet S such as normal sheet and postcard has been exemplified as the recording sheet. However, the invention is not limited thereto. For example, an OHP sheet and the like may be used.

In the above-described exemplary embodiment, the laser printer that forms a black-and-white image has been exemplified as the image forming apparatus having the fixing device of the invention. However, the invention is not limited thereto. For example, a printer that forms a color image may be also possible. Also, the image forming apparatus is not limited to the printer and may be a copier or complex machine having a document reading device such as flat bed scanner.

What is claimed is:

1. A fixing device comprising:

a first fixing member;

a second fixing member, the first fixing member and the second fixing member being configured to form a nip portion therebetween and to convey a recording sheet in a conveyance direction at the nip portion;

an urging mechanism comprising an urging member, the urging mechanism being configured to urge the first fixing member toward the second fixing member by an urging force of the urging member;

a first frame configured to support the second fixing member;

a second frame opposite to the second fixing member relative to the first fixing member; and a switching member configured to switch a width of the nip portion, wherein the switching member comprises:

a cam to which the urging force of the urging member is applied; and a shaft configured to support the cam, the shaft being arranged at a first side relative to the nip portion in the conveyance direction, wherein the first frame and the second frame are connected to each other by the shaft, and wherein the first frame and the second frame are made of resin, and wherein a second side, which is opposite to the first side relative to the nip portion in the conveyance direction is provided with a restraint part configured to suppress the second frame from oscillating relative to the first frame about the shaft.

2. The fixing device according to claim 1, wherein the shaft is made of metal.

3. The fixing device according to claim 1, wherein the first frame comprises a first opening into which the shaft is inserted.

4. The fixing device according to claim 3, wherein the first opening is a hole.

5. The fixing device according to claim 3, wherein the first opening is a notch.

6. The fixing device according to claim 4, wherein the cam comprises a cylindrical part made of resin and protrudes axially, wherein the shaft is configured to be inserted into the cylindrical part, and wherein the cylindrical part is configured to be inserted into a hole of the first frame and to be rotatably supported by the corresponding hole.

7. The fixing device according to claim 1, wherein the second frame comprises a second opening into which the shaft is inserted.

8. The fixing device according to claim 7, wherein the second opening is a hole.

9. The fixing device according to claim 7, wherein the second opening is a notched part.

10. The fixing device according to claim 7, wherein the second opening is arranged at both end portions and a central portion of the second frame in an axial direction of the shaft.

11. The fixing device according to claim 1, wherein the second frame comprises:

a conveyance roller configured to convey the recording sheet;

a bearing part configured to rotatably support the conveyance roller;

a guide recess extending from an outer surface of the second frame toward the bearing part and configured to guide the conveyance roller to the bearing part; and an elastic member configured to urge the conveyance roller toward the bearing part, and wherein the shaft is disposed on a trajectory of the conveyance roller guided by the guide recess.

12. The fixing device according to claim 1, further comprising:

a belt having an endless shape;

a nip plate configured to contact with an inner surface of the belt, the nip plate and the second fixing member being configured to nip the belt therebetween, wherein the nip plate is the first fixing member.

13. The fixing device according to claim 1, wherein the second fixing member is a pressing roller.

14. The fixing device according to claim 1, wherein the urging member includes a spring.

15. The fixing device according to claim 14, wherein the spring includes a coil spring.

16. The fixing device according to claim 1, wherein the first fixing member is located between at least a portion of the first frame and at least a portion of the second frame.

17. A fixing device comprising:

a belt having an endless shape;

a first fixing member comprising a nip plate;

a second fixing member, the first fixing member and the second fixing member being configured to form a nip portion therebetween, wherein the nip plate is configured to contact an inner surface of the belt, the nip plate and the second fixing member being configured to nip the belt therebetween;

an urging assembly comprising a spring, the urging assembly being capable of urging the first fixing member toward the second fixing member;

a first frame supporting the second fixing member;

a second frame, the second fixing member being disposed between at least a portion of the first frame and at least a portion of the second frame; and a switching member comprising:

a cam; and a shaft supporting the cam, wherein the first frame and the second frame are connected to each other by the shaft, wherein the first frame includes a resin frame, and wherein the second frame includes a resin frame.

18. The fixing device according to claim 17, wherein a cam has a hole, and wherein the shaft fits the hole of the cam.

19. The fixing device according to claim 18, wherein the first frame has a first opening and the second frame has a second opening, and wherein the shaft fits the first opening and the second opening.

20. The fixing device according to claim 17, wherein the second fixing member is a pressing roller.

21. The fixing device according to claim 17, wherein the shaft includes a metal shaft.

22. A fixing device comprising:

a nip member comprising a nip plate;

an endless belt;

a pressing roller, the nip member and the pressing roller being configured to nip the endless belt therebetween;

a first frame supporting the pressing roller;

a second frame, the pressing roller being disposed between at least a portion of the first frame and at least a portion of the second frame;

a cam; and a shaft supporting the cam, wherein the first frame and the second frame are connected to each other by the shaft, wherein the first frame includes a resin frame, and wherein the second frame includes a resin frame.

* * * * *